US006621382B2

(12) United States Patent
Nitta

(10) Patent No.: US 6,621,382 B2
(45) Date of Patent: Sep. 16, 2003

(54) NOISE FILTER AND HIGH FREQUENCY TRANSMITTER USING NOISE FILTER

(75) Inventor: Hitoshi Nitta, Sakai (JP)

(73) Assignee: Sharp Kabushiki Kaisha, Osaka (JP)

( * ) Notice: Subject to any disclaimer, the term of this patent is extended or adjusted under 35 U.S.C. 154(b) by 12 days.

(21) Appl. No.: 09/996,798

(22) Filed: Nov. 30, 2001

(65) Prior Publication Data

US 2002/0070824 A1 Jun. 13, 2002

(30) Foreign Application Priority Data

Dec. 11, 2000 (JP) ..... 2000-375937

(51) Int. Cl.[7] ..... H01P 1/203
(52) U.S. Cl. ..... 333/204; 333/12
(58) Field of Search ..... 333/204, 238, 333/12

(56) References Cited

U.S. PATENT DOCUMENTS 2,819,452 A * 1/1958 Arditi et al. ..... 333/204
3,875,538 A * 4/1975 Minet et al. ..... 333/204

FOREIGN PATENT DOCUMENTS

JP 10-65402 3/1998

* cited by examiner

*Primary Examiner*—Robert Pascal
*Assistant Examiner*—Stephen E. Jones
(74) *Attorney, Agent, or Firm*—Nixon & Vanderhye P.C.

(57) ABSTRACT

A main microstrip line, one end of which has an input signal supplied thereto and other end of which outputs a signal, is formed on a substrate. Five sub-microstrip lines are made to intersect with the main microstrip line, and are disposed one by one such that their lengths from the intersections to their respective ends vary. The sub-microstrip lines are each formed in a generally rectangular shape with their line widths all formed to have the same prescribed length, and are disposed all at the same prescribed intervals and generally parallel to one another.

17 Claims, 9 Drawing Sheets

NOISE FILTER AND HIGH FREQUENCY TRANSMITTER USING NOISE FILTER

BACKGROUND OF THE INVENTION

1. Field of the Invention

The present invention relates to a noise filter and a high frequency transmitter using the same. More specifically, the present invention relates to a noise filter formed by a microstrip line provided on a substrate and a high frequency transmitter provided with such a noise filter on the output side of a transmission power ampflifier.

2. Description of the Background Art

In recent years, rapid progress is made in the market for the radio communication using high frequencies in many systems such as broadcasting satellites and communications satellites. At the same time, the demand is increasing day by day for two-way communication according to the development of the Internet. In the two-way communication in the satellite communication, reception is implemented by LNB (Low Noise Block Down Converter) as is conventionally done, while transmission is implemented by newly using a high frequency transmitter.

FIG. 8 is a block diagram representing an arrangement of a conventional high frequency transmitter, FIG. 9 is a diagram illustrating the shape of a reception band noise filter used in the conventional high frequency transmitter, and FIG. 10 is a simulation result for a conventional reception band noise filter.

Now, a high frequency transmitter of a conventional example will be described with reference to FIGS. 8 to 10. An IF (intermediate frequency) signal input to the high frequency transmitter shown in FIG. 8 is input to a mixer circuit 2 after having its gain ensured by an IF amplifier 1. In mixer circuit 2, a local oscillation signal from a local oscillation circuit 3 and the IF signal are mixed, and the IF signal is frequency-converted into a high frequency signal. The high frequency signal output from mixer circuit 2, after passing through a band-pass filter 4 that attenuates the spurious that is generated in mixer circuit 2, obtains a large gain from a circuit configured by three high frequency amplifiers 5, 6, and 7.

The output from high frequency amplifier 7 is input via a band-pass filter 8 that attenuates the amplified spurious to a high frequency amplifier 9, and together with a succeeding driver amplifier 10, more gain is earned. The output of driver amplifier 10 is input via a reception band noise filter 11 that limits the noise level of the reception frequency band down to a negligible level to a power amplifier 12, and becomes a high power signal required for transmission to a satellite. The high frequency signal output from power amplifier 12 passes via a reception band noise filter 13 that once again attenuates the noise level of the reception frequency band that has risen from the thermal noise level due to the gain of power amplifier 12 and an isolator 14 for ensuring isolation between an RF output and reception band noise filter 13 and is output from the high frequency transmitter (not shown).

Now, as shown in FIG. 9, for reception band noise filters 11 and 13, a microstrip filter is generally employed which is formed by a main microstrip line 15, one end of which has an input signal supplied thereto and the other end of which outputs a signal, and three sub-microstrip lines 16, 17, and 18 that are disposed together one by one such that they run orthogonal to main microstrip line 15.

The reason for employing a filter of such a shape lies in that it allows large attenuation to be obtained in relation to the reception frequency band, while at the same time, the loss in the transmission frequency band can be limited to as low as 1 dB. When the loss is great in the transmission frequency band of reception band noise filter 13 disposed downstream to power amplifier 12, there is a need to select a power amplifier of the type having large output power (the type having large saturation power) for power amplifier 12. The power amplifier with large output power also involves high power consumption and greater heat generation so that the shape of the overall high frequency transmitter must be enlarged for the purpose of heat radiation, which, as a result, goes against the conditions such as compactness and low power consumption for its widespread use. Therefore, a filter of the shape as shown in FIG. 9 that has small loss in the transmission frequency band is employed.

The signal pass characteristic of the filter shown in FIG. 9 is indicated by the simulation result shown in FIG. 10. As shown in FIG. 10, the filter is optimized such that a signal can pass through at a transmission frequency of 14 to 14.5 GHz and attenuates at a reception frequency of 10.95 to 12.75 GHz, and the loss of the transmission frequency is about 1 dB and the attenuation of the reception frequency obtained is at least 25 dB.

When the noise level of the reception frequency band that is input to power amplifier 12 is lowered to the thermal noise level (−173.5 dBm/Hz (25° C.)) due to the attenuation of band-pass filters 4 and 8 and reception band noise filter 11, and when the small signal gain of power amplifier 12 is 20 dB and the noise figure is 7 dB, the noise level of the reception frequency band output from power amplifier 12 rises as high as −173.5+20+7=−146.5 dBm/Hz. This level, however, would be limited to −146.5−25=−171.5 dBm/Hz by being input into reception band noise filter 13 having the shape and characteristic of FIGS. 9 and 10. The specifications of the reception band noise level of a common high frequency transmitter is about −165 dBm/Hz or below, and it can be recognized that the specifications are satisfied by the effect of reception band noise filter 13.

The recent development trends involve movements toward widely spreading high frequency transmitters among ordinary households as well as achieving lower cost and compactness, and a high gain type power amplifier with a small signal gain of about 35 dB is increasingly being adopted. By employing a high gain type power amplifier, components such as a driver amplifier and a high frequency amplifier become unnecessary, which contributes to cost and size reduction.

The increase in the small signal gain of the power amplifier, however, leads to greater increase in the noise level of the reception frequency band, which leads to the problem of the specifications of the reception band noise level not being satisfied.

Let us assume a case where a power amplifier 12 shown in FIG. 8 is replaced by a power amplifier 19 having a small signal gain of 35 dB. When the noise level of the reception frequency band input to power amplifier 19 is lowered to the thermal noise level (−173.5 dBm/Hz (25°)), with the small signal gain of power amplifier 19 being 35 dB and the noise figure being 7 dB, the noise level of the reception frequency band output from power amplifier 19 rises as high as −173.5+35+7=−131.5 dBm/Hz. By inputting a signal to reception band noise filter 13 having the shape and characteristic of FIGS. 9 and 10, the level can be limited to −131.5−25=−156.5 dBm/Hz; however, this level does not satisfy the specifications of the reception band noise level of a general high frequency transmitter of about −165 dBm/Hz.

SUMMARY OF THE INVENTION

Thus, the principal object of the present invention is to provide a noise filter having large attenuation in the reception frequency band and a high frequency transmitter using the same.

In short, according to the present invention, a noise filter formed by a microstrip line disposed on a substrate includes a main microstrip line, one end of which has an input signal supplied thereto and other end of which outputs a signal, and at least first to fifth sub-microstrip lines disposed together one by one such that they intersect with the main microstrip line and their lengths from the intersections to their respective ends vary.

Thus, according to the present invention, the attenuation can be made large in the reception frequency band by disposing at least first to fifth sub-microstrip lines such that they intersect with the main microstrip line.

Preferably, the first to fifth sub-microstrip lines are each formed in a generally rectangular shape.

Consequently, the frequency selectivity of the filter improves, and the frequency resolution can be enhanced.

Preferably, the line widths of the first to fifth sub-microstrip lines are all formed to have the same prescribed length.

Consequently, the Q-values of all sub-microstrip lines can be made the same. By optimizing the line width according to the frequency bandwidth of the attenuation band or the pass bandwidth of a signal required, a filter can be provided that has large attenuation in the attenuation band, excellent flatness in the pass band, and small pass loss.

More preferably, the sub-microstrip lines are each disposed all at the same prescribed intervals and generally parallel to one another so that it becomes possible to prevent high frequency coupling between the sub-microstrip lines and to prevent degradation in characteristics as a filter.

More preferably, of the first to fifth sub-microstrip lines, the first, third, and fifth sub-microstrip lines are disposed such that they are shifted in one direction generally orthogonal to the main microstrip line and the second and fourth sub-microstrip lines are disposed such that they are shifted in other direction generally orthogonal to the main microstrip line.

As a result, coupling between adjacent sub-microstrip lines can be prevented, and the degradation in characteristics as a filter can be prevented.

More preferably, with the third sub-microstrip line in the center, the first and second sub-microstrip lines and the fourth and fifth sub-microstrip lines are disposed in line symmetry.

Consequently, the first and fourth sub-microstrip lines would have the same length and the second and fifth sub-microstrip lines would have the same length, and it becomes possible to obtain an even larger attenuation in the attenuation band with the resonance points overlapping at the same frequency.

More preferably, with respective intersections of the main microstrip line and the first and fifth sub-microstrip lines serving as boundaries, the line width is set such that the portion between the first sub-microstrip line and the fifth sub-microstrip line becomes greater in width than the portions between the intersections and the one end and the other end.

Thus, inductivity of the main microstrip line can be limited, and the impedance in high frequency band is reduced, and the insertion loss in the pass band of the noise filter can be limited.

More preferably, with respective intersections of the main microstrip line and the first to fifth sub-microstrip lines serving as boundaries, respective line widths are set such that they become greater closer to the third sub-microstrip line away from the one end and the other end portion.

As a result, inductivity of the main microstrip line can be limited, and the impedance in high frequency band is reduced. At the same time, impedance mismatch can be alleviated in the discontinuous portions of the line width created by making the line width greater away from one end and the other end portion, and the insertion loss in the pass band of the noise filter can be limited.

More preferably, the line length of the third sub-microstrip line can be changed so as to set the pass frequency bandwidth to the desired band.

According to another aspect of the present invention, a noise filter formed by a microstrip line disposed on a substrate is connected to the output side of a transmission power amplifier for amplifying a high frequency transmission signal, and the noise filter includes a main microstrip line, one end of which has an input signal supplied thereto and other end of which outputs a signal, and at least first to fifth sub-microstrip lines disposed together one by one such that they intersect with the main microstrip line and their lengths from the intersections to their respective ends vary.

The noise filter thus configured has small insertion loss in the pass band, can ensure output VSWR (Voltage Standing Wave Ratio) characteristic of the transmission output without an isolator, and can omit the corresponding amount for the insertion loss of the isolator so that the output power of the transmission power amplifier would suffer little burden, and advantages can be gained in terms of heat radiation and chassis shape.

Moreover, the line length of a sub-microstrip line of the noise filter can be adjusted so as to improve the output return loss of the high frequency transmitter.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
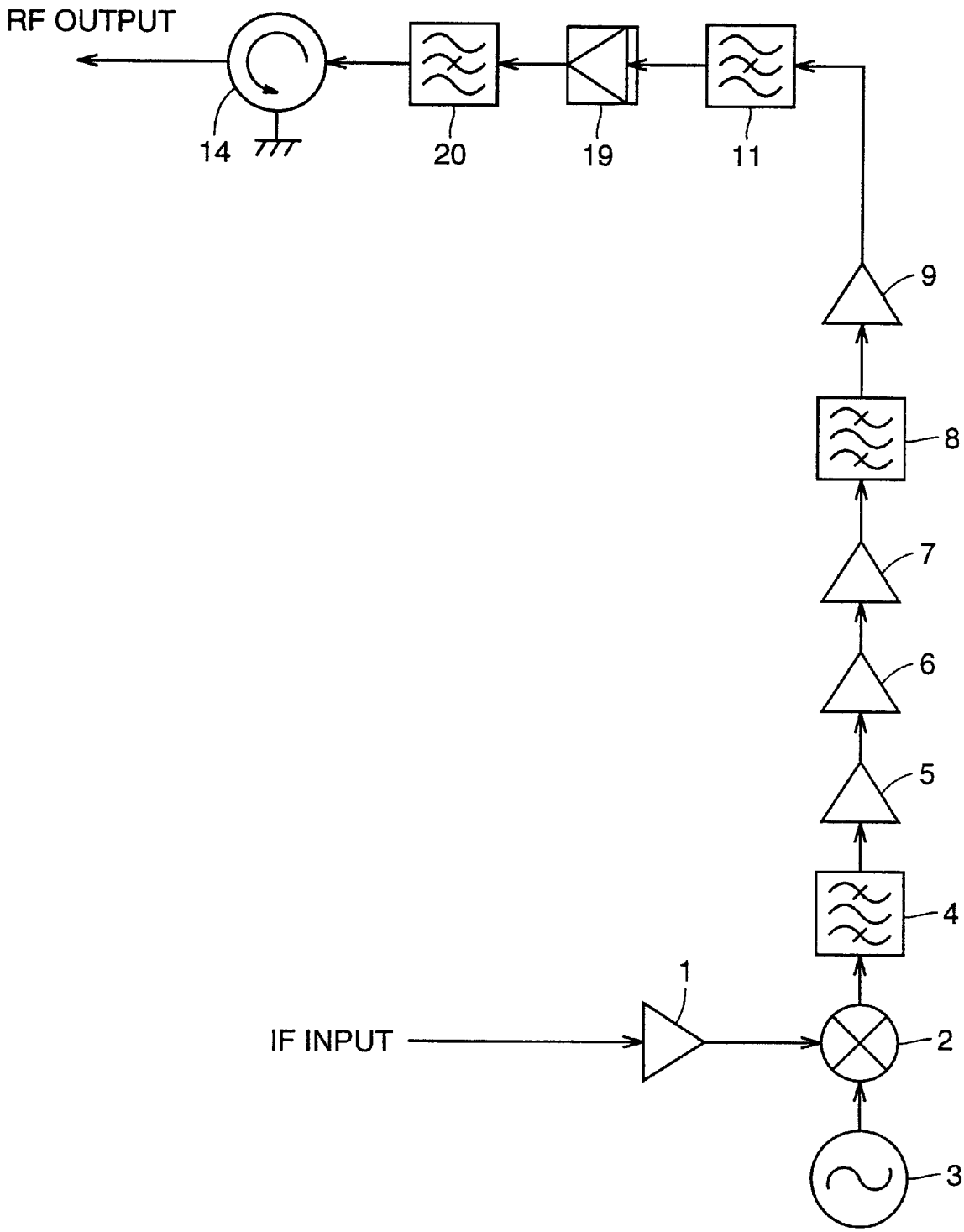
FIG. 1 is a block diagram of a high frequency transmitter of one embodiment according to the present invention.

FIG. 1 is a block diagram of a high frequency transmitter of one embodiment according to the present invention. In FIG. 1, the inputted IF signal is input to a mixer circuit 2 after having its gain ensured by an IF amplifier 1. In mixer circuit 2, a local oscillation signal from a local oscillation circuit 3 and the IF signal are mixed and the IF signal is frequency-converted into a high frequency signal. The high frequency signal output from mixer circuit 2 obtains a large gain from a circuit configured by three high frequency amplifiers 5, 6, and 7 via a band-pass filter 4 provided in mixer circuit 2 for attenuating the spurious.

Figure 8:
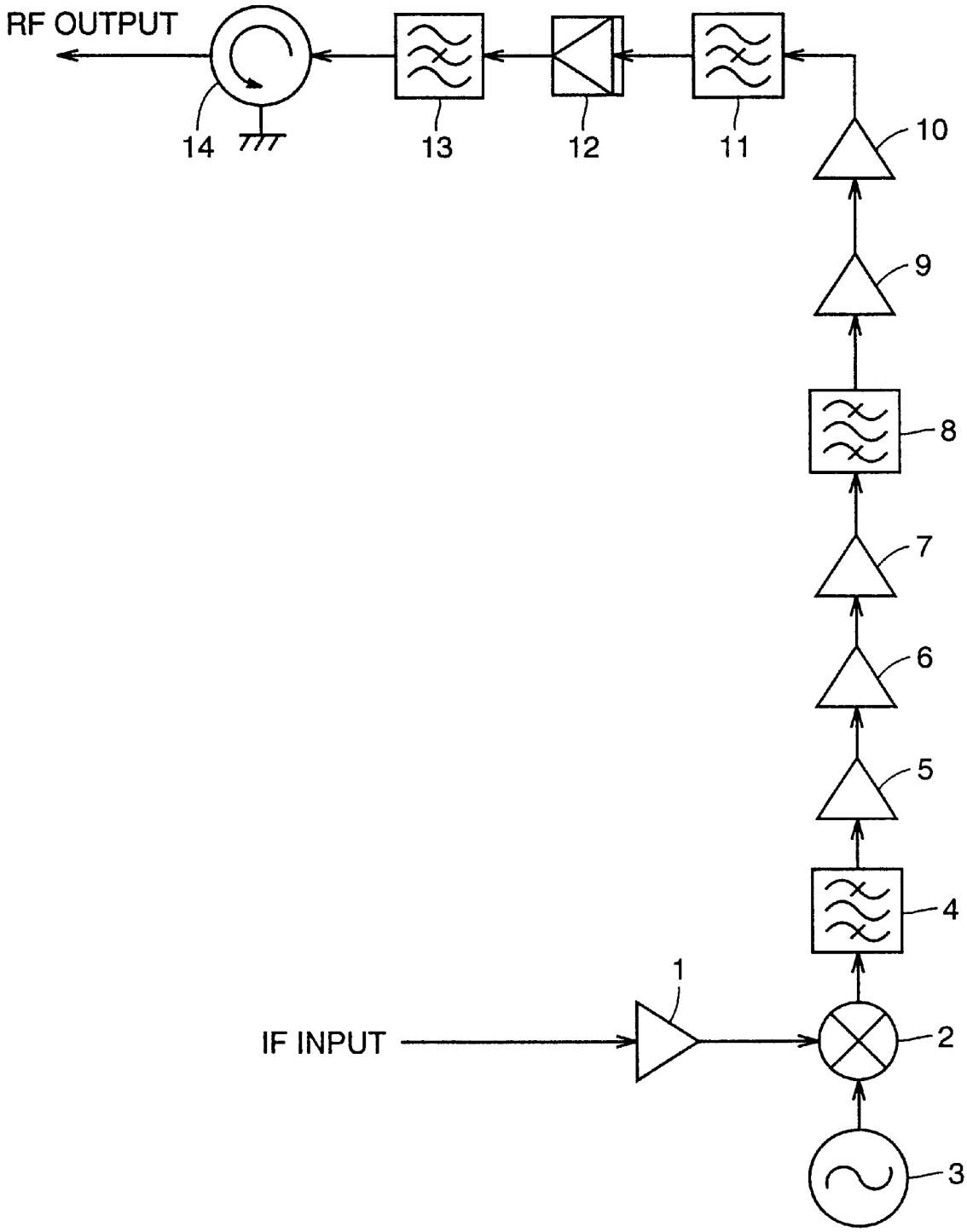
FIG.8 PRIOR ART
FIG. 8 is a block diagram representing an arrangement of a conventional high frequency transmitter.

The output from high frequency amplifier 7 is input via a band-pass filter 8 that attenuates the amplified spurious to a high frequency amplifier 9. The output from high frequency amplifier 9 passes via a reception band noise filter 11 that limits the noise level down to a negligible level and is input to a power amplifier 19. Power amplifier 19 is of a high gain type with a small signal gain of about 35 dB so that the gain of driver amplifier 10 shown in FIG. 8 described above is not necessary, and thus the driver amplifier is not employed. The high frequency signal output from power amplifier 19 passes via a reception band noise filter 20 that once again limits the noise level of the reception frequency band that has risen from the thermal noise level due to the gain of power amplifier 19 and an isolator 14 for ensuring isolation between the output and the reception band noise filter, and is output from the high frequency transmitter.

Figure 2:
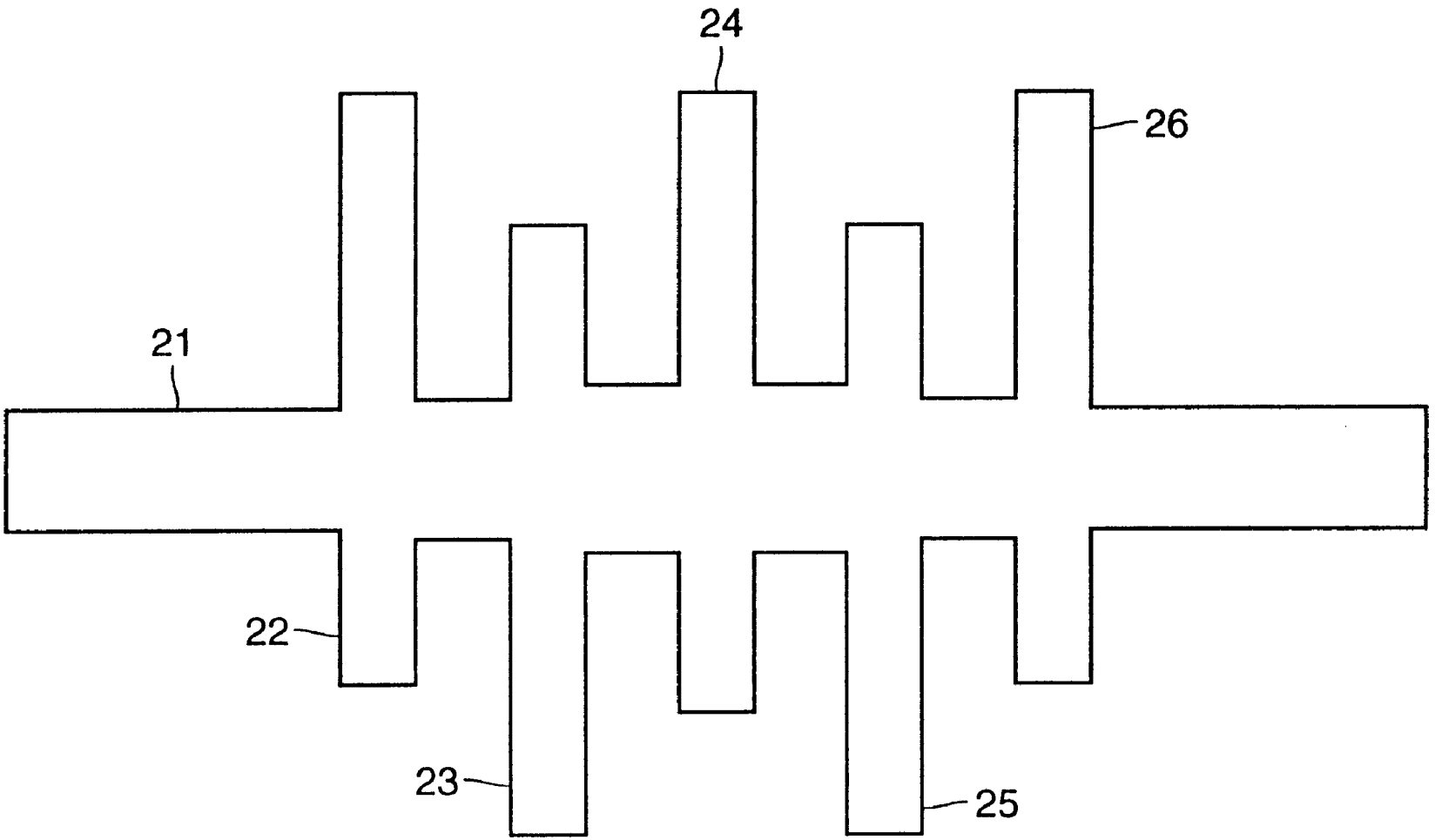
FIG. 2 is a diagram illustrating the shape of a reception band noise filter used in the embodiment of the present invention.

FIG. 2 is a diagram illustrating the shape of reception band noise filter 20 shown in FIG. 1.

In reception band noise filter 20, as shown in FIG. 2, an input signal is supplied to one end of a main microstrip line 21 and a signal is output from the other end side. At least five first to fifth sub-microstrip lines 22, 23, 24, 25, and 26 are formed disposed together one by one such that they intersect with main microstrip line 21 and their lengths from the intersections to their respective ends vary, forming a microstrip filter.

In reception band noise filter 20, sub-microstrip lines 22, 23, 24, 25, and 26 are each formed in a generally rectangular shape, and the line widths of sub-microstrip lines 22, 23, 24, 25, and 26 are all formed to have the same prescribed length. In addition, sub-microstrip lines 22, 23, 24, 25, and 26 are each disposed all at the same prescribed intervals and generally parallel to one another.

Moreover, sub-microstrip lines 22, 23, 24, 25, and 26 are disposed generally orthogonal to main microstrip line 21, with the first, third, and fifth sub-microstrip lines 22, 24, and 26 being disposed such that they are shifted in one direction generally orthogonal to main microstrip line 21 and the second and fourth sub-microstrip lines 23 and 25 being disposed such that they are shifted in other direction generally orthogonal to main microstrip line 21.

Furthermore, of sub-microstrip lines 22, 23, 24, 25, and 26, with sub-microstrip line 24 in the center, sub-microstrip lines 22 and 23 and sub-microstrip lines 25 and 26 are disposed in line symmetry. In addition, with respective intersections of main microstrip line 21 and sub-microstrip lines 22, 23, 24, 25, and 26 serving as boundaries, their line widths are set such that they become greater in width closer toward sub-microstrip line 24 away from one end portion to which an input signal is supplied and the other end portion from which a signal is output.

Figure 3:
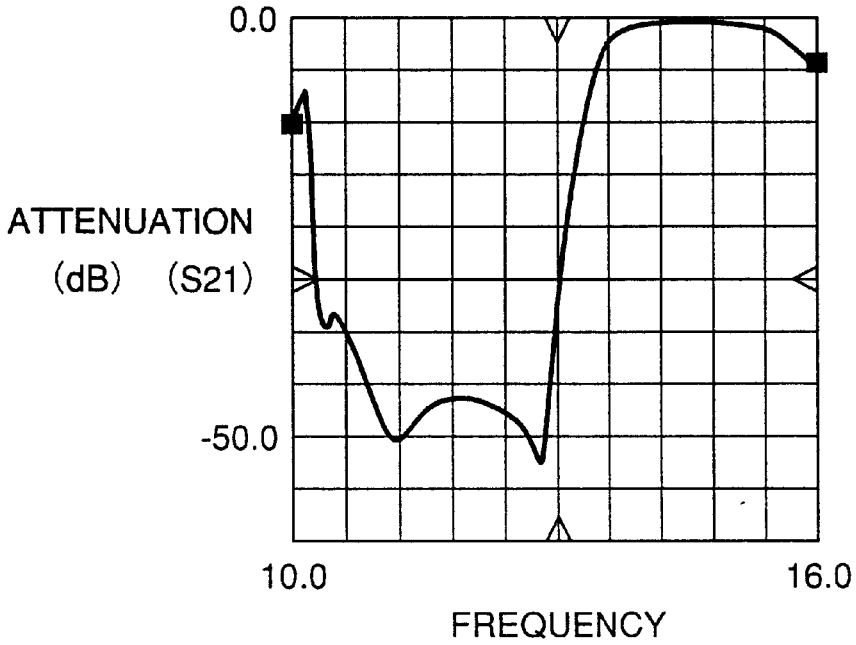
FIG. 3 is a diagram showing a simulation result of the reception band noise filter shown in FIG. 2.
Figure 4:
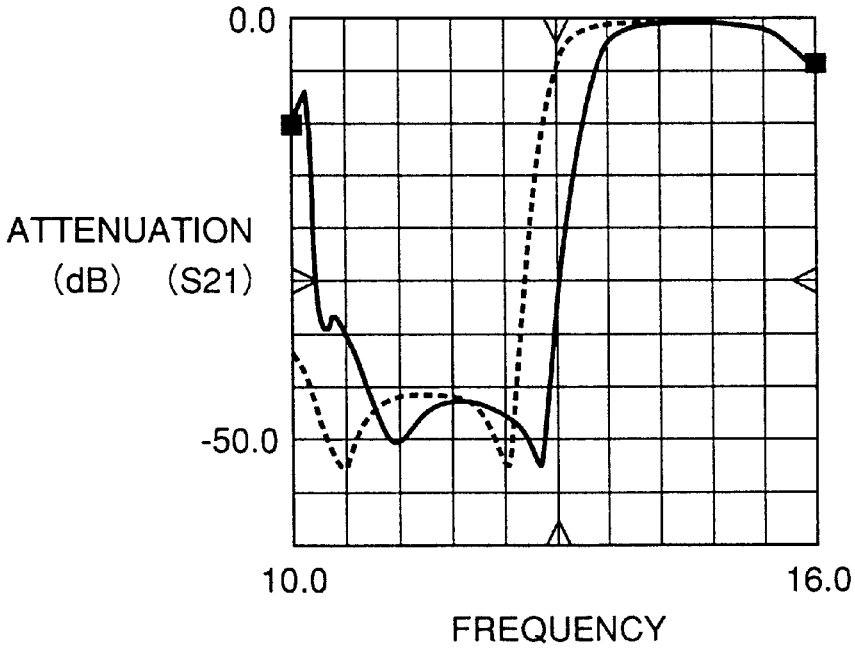
FIG. 4 is another diagram showing a simulation result of the reception band noise filter.

FIGS. 3 and 4 are diagrams showing the simulation results of the reception band noise filter.

Reception band noise filter 20 configured as shown in FIG. 2 can be set to the desired band in that, by lengthening the line length of sub-microstrip line 24, the band can be shifted toward lower frequencies from the solid line to the broken line shown in FIG. 4, and conversely, by shortening the line length, the band can be shifted toward higher frequencies.

Figure 9:
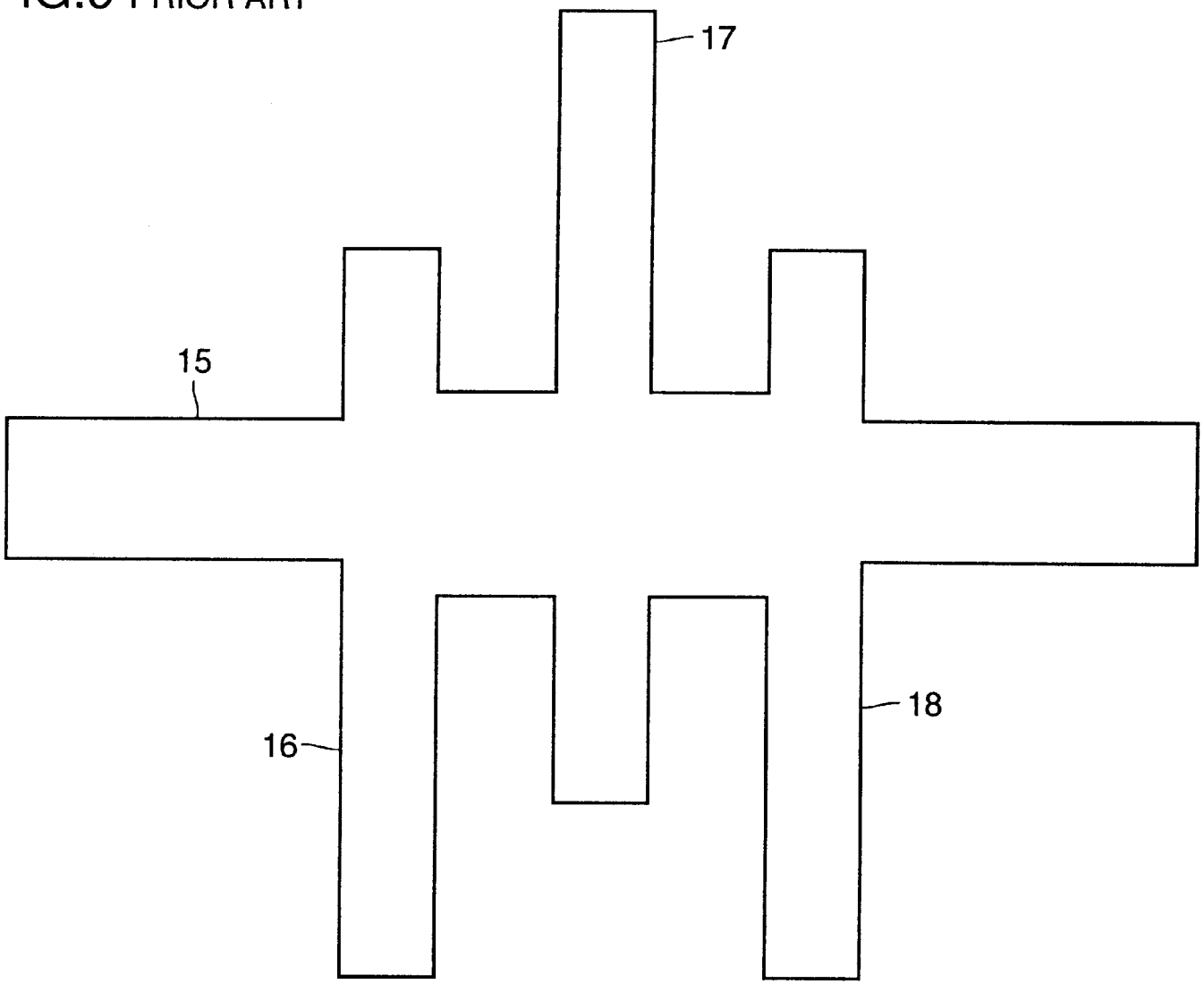
FIG.9 PRIOR ART
FIG. 9 is a diagram illustrating the shape of a reception band noise filter used in the conventional high frequency transmitter.
Figure 10:
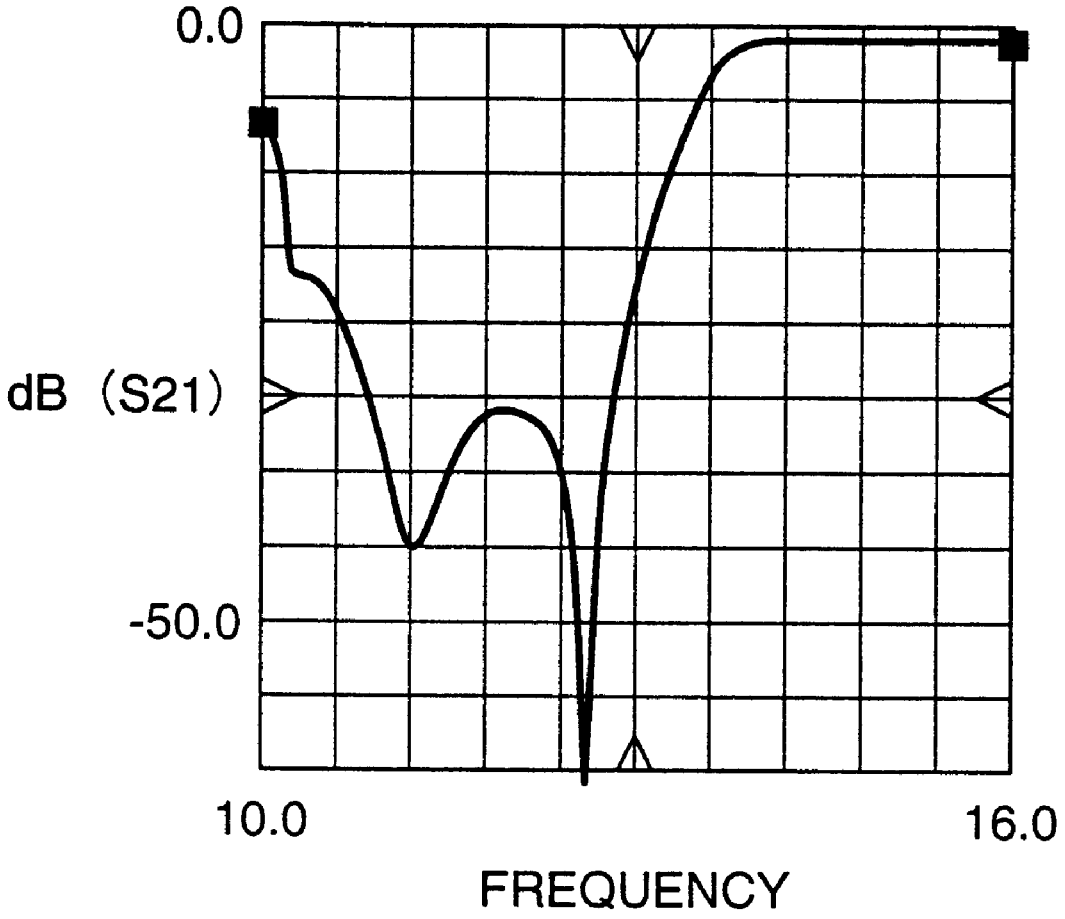
FIG.10 PRIOR ART
FIG. 10 is a simulation result for the reception band noise filter used in the conventional high frequency transmitter.

In addition, in FIG. 3, the filter is optimized such that a signal can pass through at a transmission frequency of 14 to 14.5 GHz and attenuates at a reception frequency of 10.95 to 12.75 GHz, and the loss of the transmission frequency is 0.85 dB or below and the attenuation of the reception frequency obtained is at least 35 dB. When compared with the simulation result of the reception band noise filter of the conventional example of FIG. 9, the attenuation of the reception frequency has improved by 10 dB from 25 dB to 35 dB. The noise level of the reception frequency band at this time is calculated as follows.

When the noise level of the reception frequency band that is input to power amplifier 19 is lowered to the thermal noise level (−173.5 dBm/Hz (25° C.)) due to the attenuation of band-pass filters 4 and 8 and reception band noise filter 11, and when the small signal gain of power amplifier 19 is 35 dB and the noise figure is 7 dB, the noise level of the reception frequency band output from power amplifier 19 rises to as high as −173.5+35+7=−131.5 dBm/Hz. This level, however, would be limited to −131.5−35=166.5 dBm/Hz through reception band noise filter 20 having the shape shown in FIG. 2 and characteristic shown in FIG. 3. The specifications of the reception band noise level of a common high frequency transmitter is about −165 dBm/Hz or below, and it can be recognized that the specifications are satisfied by substituting reception band noise filter 20.

Figure 5:
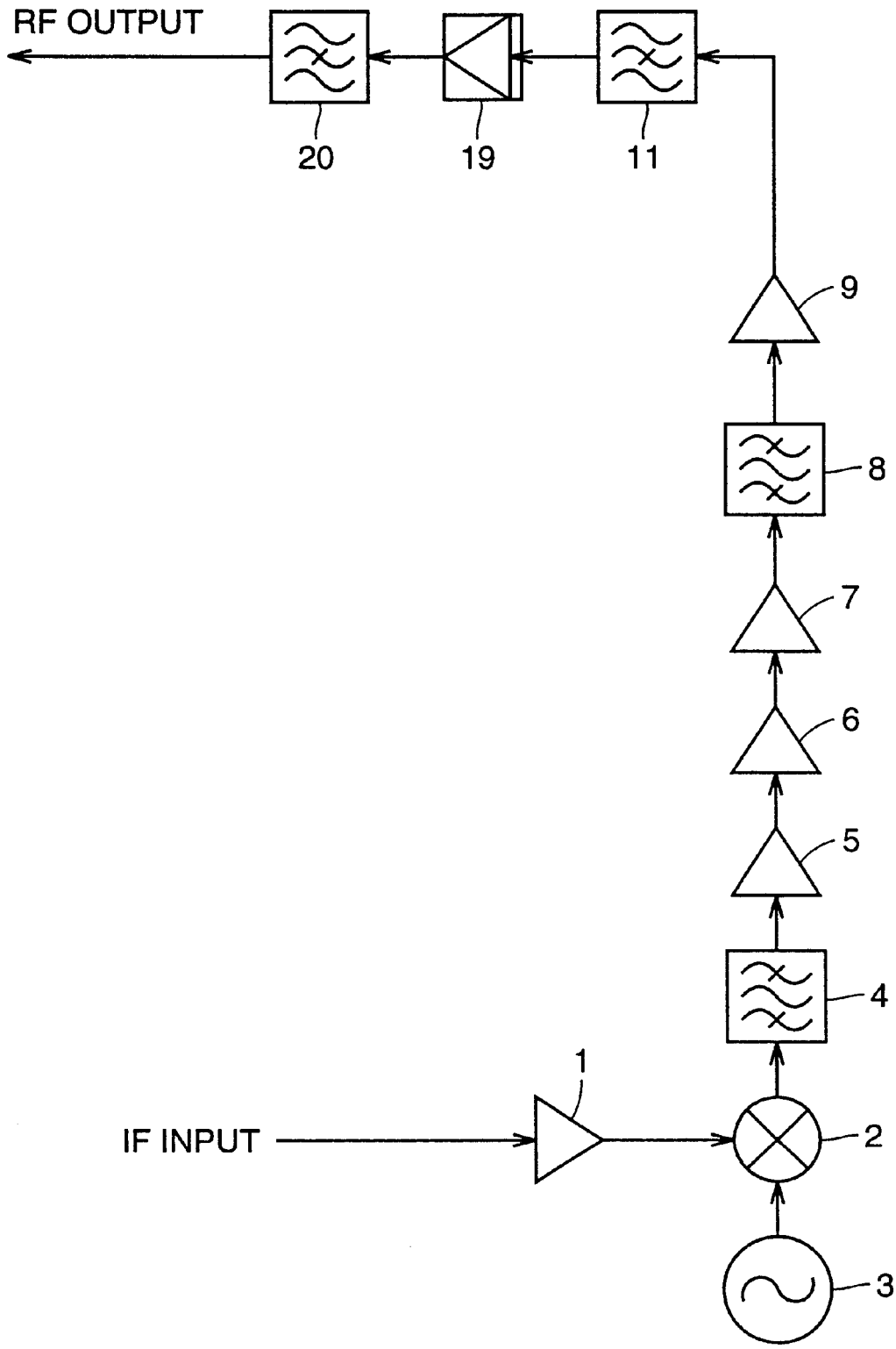
FIG. 5 is a block diagram of a high frequency transmitter of another embodiment according to the present invention.

FIG. 5 is a block diagram of a high frequency transmitter showing another embodiment of the present invention. The arrangement of this embodiment shown in FIG. 5 has isolator 14 shown in FIG. 1 omitted. Omission of isolator 14 achieves reduction in the cost of the parts. In addition, the insertion loss of the transmission signal in isolator 14 is eliminated so that the output power of power amplifier 19 can be made small, and advantages can be gained in terms of heat radiation and chassis shape.

The isolator, however, serves to ensure isolation between the RF output and power amplifier 19, and the absence of the isolator leads to the characteristics of the output return loss of power amplifier 19 greatly affecting the output return loss of the high frequency transmitter.

Figure 6:
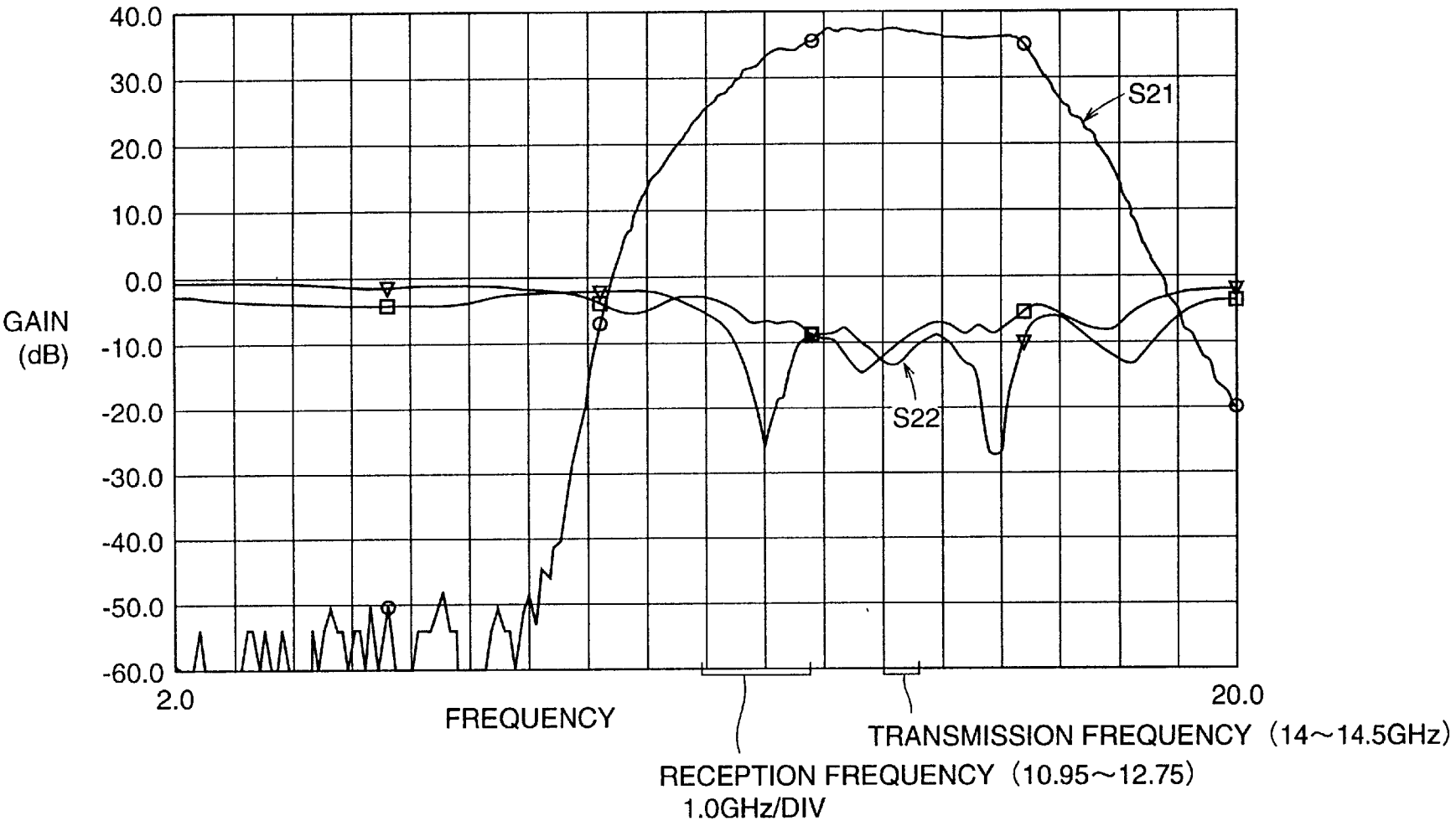
FIG. 6 is a diagram showing a simulation result of another embodiment according to the present invention.

FIG. 6 is a diagram showing the S-parameter characteristic of power amplifier 19 alone. The worst value of an output return loss S22 in the transmission frequency band (14 to 14.5 GHz) becomes −11.3 dB.

In general, the specifications of the output return loss of the high frequency transmitter is about −7 to −15 dB, which is difficult to satisfy with the characteristics of FIG. 6. By adjusting and optimizing the shape and dimensions of reception band noise filter 20 disposed on the output side of power amplifier 19, however, the output return loss of the high frequency transmitter can be improved.

Figure 7:
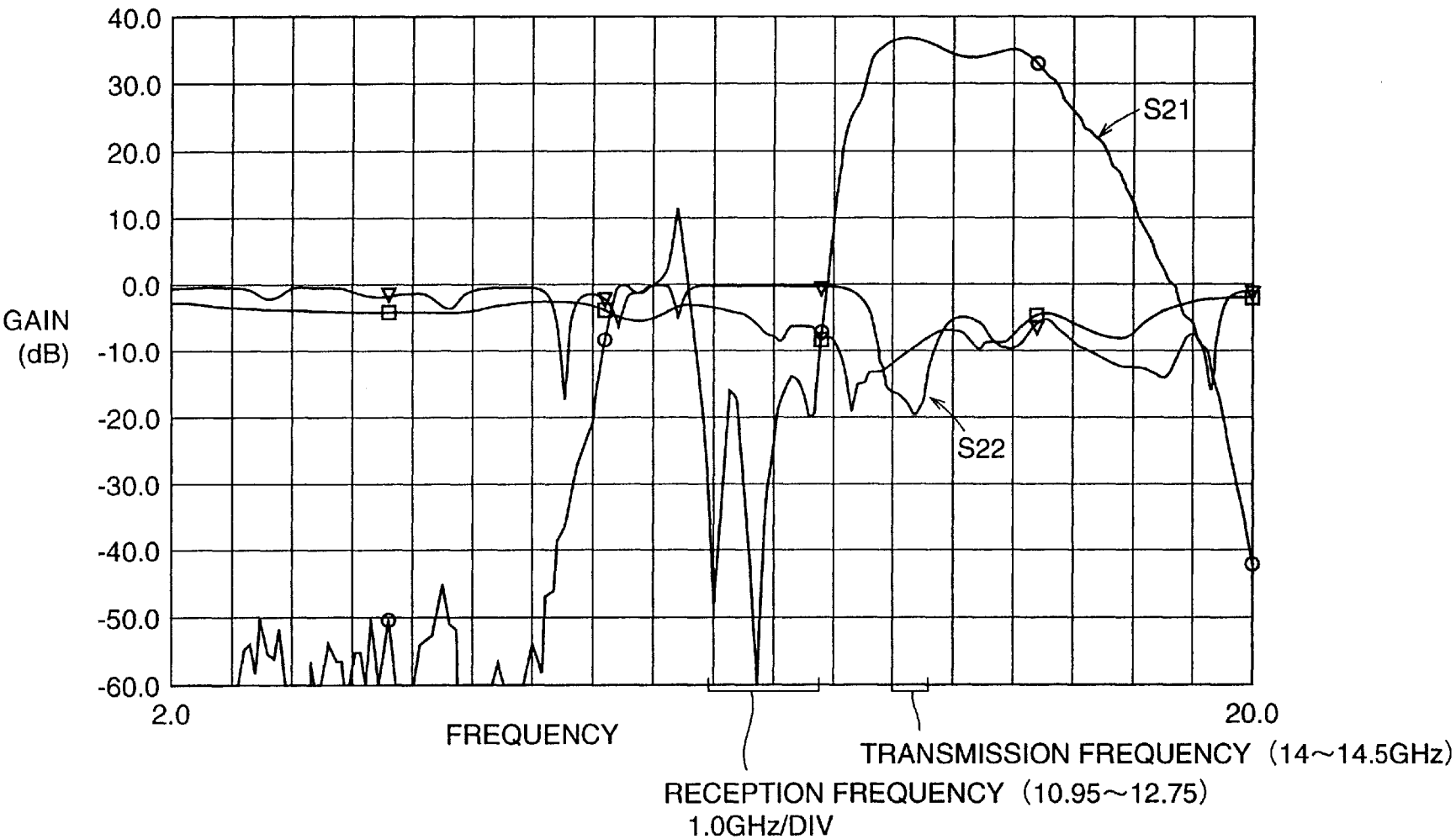
FIG. 7 is a diagram showing a simulation result of still another embodiment according to the present invention.

FIG. 7 shows the S-parameter characteristic of power amplifier 19+reception band noise filter 20 when the dimensions of reception band noise filter 20 is optimized. In FIG. 7, with regard to pass characteristic (S21), the gain in the reception band (10.95 to 12.75 GHz) is greatly limited, and the worst value of the output return loss (S22) in the transmission band is −16.3 dB, which shows improvement by 5 dB as compared to the case of the power amplifier alone. In this manner, by adjusting reception band noise filter 20, the output return loss of the high frequency transmitter can be improved even without the isolator.

As described above, according to the embodiment of the present invention, by having at least five sub-microstrip lines intersect with the main microstrip line and disposing them one by one such that the lengths of the sub-microstrip lines from the intersections to their respective ends vary, the attenuation of the reception frequency band can be made large, the frequency selectivity of the filter can be improved, and the frequency resolution can be enhanced.

Moreover, by connecting such a noise filter to the output side of a transmission power amplifier for amplifying a high frequency transmission signal, the noise level of the reception frequency band can be reduced.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A noise filter formed by a microstrip line disposed on a substrate, comprising:

a main microstrip line, one end of which has an input signal supplied thereto and other end of which outputs a signal; and at least first to fifth sub-microstrip lines disposed together one by one such that they intersect with said main microstrip line and their lengths from intersections to their respective ends wherein said at least first to fifth sub-microstrip lines are disposed generally orthogonal to said main microstrip line, said first, third, and fifth sub-microstrip lines being disposed such that they are shifted in one direction generally orthogonal to said main microstrip line and said second and fourth sub-microstrip lines being disposed such that they are shifted in the other direction generally orthogonal to said main microstrip line.

2. The noise filter according to claim 1, wherein said at least first to fifth sub-microstrip lines are each formed in a generally rectangular shape.

3. The noise filter according to claim 1, wherein at least first to fifth sub-microstrip lines have the same length.

4. The noise filter according to claim 1, wherein said at least first to fifth sub-microstrip lines are each disposed all at same prescribed intervals and generally parallel to one another.

5. The noise filter according to claim 1, wherein a line length of said third sub-microstrip line is defined to set a pass frequency bandwidth to a desired band.

6. The noise filter according to claim 1, wherein of said at least first to fifth sub-microstrip lines, said first and second sub-microstrip lines and said fourth and fifth sub-microstrip lines are disposed in line symmetry relative to said third sub-microstrip line.

7. The noise filter according to claim 1, wherein with respective intersections of said main microstrip line and said first and fifth sub-microstrip lines serving as boundaries, the line width of a portion of the main microstrip line between said first sub-microstrip line and said fifth sub-microstrip line is set to be greater than that of portions between the intersections and said one end and said other end.

8. The noise filter according to claim 1, wherein with respective intersections of said main microstrip line and at least said first to fifth sub-microstrip lines serving as boundaries, respective portions of the main microstrip line have widths that are set such that they become greater closer to said third sub-microstrip line away from said one end and said other end.

9. A high frequency transmitter, comprising:

a transmission power amplifier for amplifying a high frequency transmission signal; and a noise filter connected to an output side of said transmission power amplifier and formed by a microstrip line disposed on a substrate, wherein said noise filter includes a main microstrip line, one end of which has an input signal supplied thereto and other end of which outputs a signal, and at least first to fifth sub-microstrip lines disposed together one by one such that they intersect with said main microstrip line and their lengths from intersections to their respective ends vary, wherein said at least first to fifth sub-microstrip lines are disposed generally orthogonal to said main microstrip line, said first, third, and fifth sub-microstrip lines being disposed such that they are shifted in one direction generally orthogonal to said main microstrip line and said second and fourth sub-microstrip lines being disposed such that they are shifted in the other direction generally orthogonal to said main microstrip line.

10. The high frequency transmitter according to claim 9, wherein a line length of said third sub-microstrip line is defined to set a pass frequency bandwidth to a desired band.

11. The high frequency transmitter according to claim 9, wherein a line length of a sub-microstrip line of said noise fitter is defined to improve output return loss of said high frequency transmitter.

12. The high frequency transmitter according to claim 9, wherein said at least first to fifth sub-microstrip lines are each formed in a generally rectangular shape.

13. The high frequency transmitter according to claim 9, wherein said at least first to fifth sub-microstrip lines have the same length.

14. The high frequency transmitter according to claim 9, wherein said at least first to fifth sub-microstrip lines are each disposed at all same prescribed intervals and generally parallel to one another.

15. The high frequency transmitter according to claim 9, wherein with respective intersections of said main microstrip line and at least said first and fifth sub-microstrip lines serving as boundaries, respective portions of the main microstrip line have widths that are set such that they become greater closer to said third sub-microstrip line away from said one end and said other end.

16. The high frequency transmitter according to claim 9, wherein of said at least first to fifth sub-microstrip lines, said first and second sub-microstrip lines and said fourth and fifth sub-microstrip lines are disposed in line symmetry relative to said third sub-microstrip line.

17. The high frequency transmitter according to claim 9, wherein with respective intersections of said main microstrip line and said first and fifth sub-microstrip lines serving as boundaries, the line width of a portion of the main microstrip line between said first sub-microstrip line and said fifth sub-microstrip line is set to be greater than that of portions between the intersections and said one end and said other end.

* * * * *